US006062935A

United States Patent [19]

Gross

[11] Patent Number: 6,062,935

[45] Date of Patent: May 16, 2000

[54] BUBBLE GENERATOR

[76] Inventor: Stanley Gross, 1013 S. Washington St., Evans City, Pa. 16033

[21] Appl. No.: 09/106,318

[22] Filed: Jun. 29, 1998

[51] Int. Cl.[7] ..... A63H 33/28

[52] U.S. Cl. ..... 446/15; 40/408

[58] Field of Search ..... 446/15; 40/408

[56] References Cited

U.S. PATENT DOCUMENTS

| | | | |
|---|---|---|---|
| 2,133,499 | 10/1938 | Dolan | 446/15 |
| 2,301,427 | 11/1942 | Lyon, Jr. | 446/15 |
| 2,805,515 | 9/1957 | Gans et al. . | |
| 3,769,833 | 11/1973 | Ordway et al. | 446/15 |
| 3,814,394 | 6/1974 | Murray | 446/15 |
| 4,062,143 | 12/1977 | Lerman . | |
| 4,166,084 | 8/1979 | Shea | 446/15 |
| 4,775,348 | 10/1988 | Collins | 446/15 |

FOREIGN PATENT DOCUMENTS

| | | | |
|---|---|---|---|
| 1353530 | 11/1987 | U.S.S.R. | 446/15 |
| 2186199 | 8/1987 | United Kingdom | 446/15 |

*Primary Examiner*—Robert A. Hafer
*Assistant Examiner*—Jeffrey D. Carlson
*Attorney, Agent, or Firm*—Aileen Champion Addessi

[57] ABSTRACT

A bubble generator for producing a stream of uniform bubbles includes components which are stationary. The bubble generator includes a container or plenum having an inclined face plate with a plurality of nozzles positioned thereon. The nozzles are elongated slots positioned in the face plate and have an insert disposed within the slot with edges that extend within the plenum and above the surface of the face plate for facilitating formation of a liquid film across the slot. The insert may have an extension positioned at an upper portion for providing lift and buoyancy to the bubbles. A liquid supply manifold is positioned above the nozzles and directs a flow of liquid to the nozzles. As the liquid flows across the slot and is contained within the insert, a film forms across the slot without the need for any dipping or priming means. An air supply then directs air into the liquid film and produces the stream of bubbles.

17 Claims, 3 Drawing Sheets

BUBBLE GENERATOR

BACKGROUND OF THE INVENTION

The invention relates to bubble generating devices and, more particularly, to a bubble generator which develops a bubble film and stream using static components.

Existing bubble generators use a mechanical method, such as dipping with a wheel, arm or the like or a priming pad to establish a film in a wand. After the film is established, air flow through the wand produces a bubble. The film in the wand continuously drains of its water as bubbles are produced. Initially, the bubbles may be heavy, then become lighter as the liquid in the film is consumed Control over the uniformity or buoyancy of the bubble is limited. Methods to improve the hold up of a solution, such as fins, allow more bubbles to be produced each time the wand is wet, but soon the film breaks and the wand must be dipped or a priming pad used to reestablish the film.

In generators which have a continuous solution feed, a priming pad is still needed to initially establish the film, and there is very little control over the liquid flow or bubble buoyancy. These mechanisms add complexity and bulk to the generator. For example, a wheel rotating through a bubble solution produces bubbles only at a limited site over its entire area and requires a motor or other manual or mechanical means to turn the wheel. To increase the bubble rate would require an increase in the number of wands, which would greatly increase the complexity and size of the generator.

There are several kinds of bubble generators. One such device is disclosed in U.S. Pat. No. 4,062,143 issued to Lerman and entitled "Bubble Generator". The bubble generator includes a bubble generating ring having a plurality of holes for providing a desired fluid flow. However, the bubble generator includes moving components, such as a priming means engagable with the ring for priming the ring for formation of the bubbles. The priming means include a pivoting means and lever means which are required to move to prime the bubble generating ring.

Therefore, what is needed is an apparatus and method for generating a large number and a continuous stream of uniform buoyant bubbles without the use of mechanical means.

SUMMARY OF THE INVENTION

A bubble generator includes a plenum having a plurality of walls enclosing a space. At least one of the walls may be inclined relative to the ground and has a top portion, a bottom portion and a plurality of slots disposed therein and positioned therebetween. A liquid supply manifold is positioned at the top portion of the inclined wall for supplying liquid to the slots for forming a film across the slot. An air supply is in communication with the plenum for directing air through the space of the plenum and into the film positioned across the slot for forming a bubble releasable from the slot.

The bubble generator additionally includes an insert positioned within the slot and has edges which extend beyond both sides of the inclined wall and perpendicularly from the inclined wall for forming the film within the slot and for substantially preventing the liquid from contacting the inclined wall. The insert has an extension which extends vertically upwardly from the insert. The extension has a portion positioned closest to the liquid supply manifold with a width greater than a width of an edge of the insert for providing lift to the bubble. The slot is designed to allow the liquid to form a film without mechanical means. The bubble size can be controlled by the air flow and the slot dimensions.

A process for producing bubbles includes dispensing liquid from a liquid supply manifold and directing the flow of the liquid to at least one stationary nozzle. As the liquid flows across the stationary nozzles, a film is formed across each stationary nozzle. A flow of air is directed into the film for expanding the film and producing a stream of bubbles.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENTS

Figure 1:
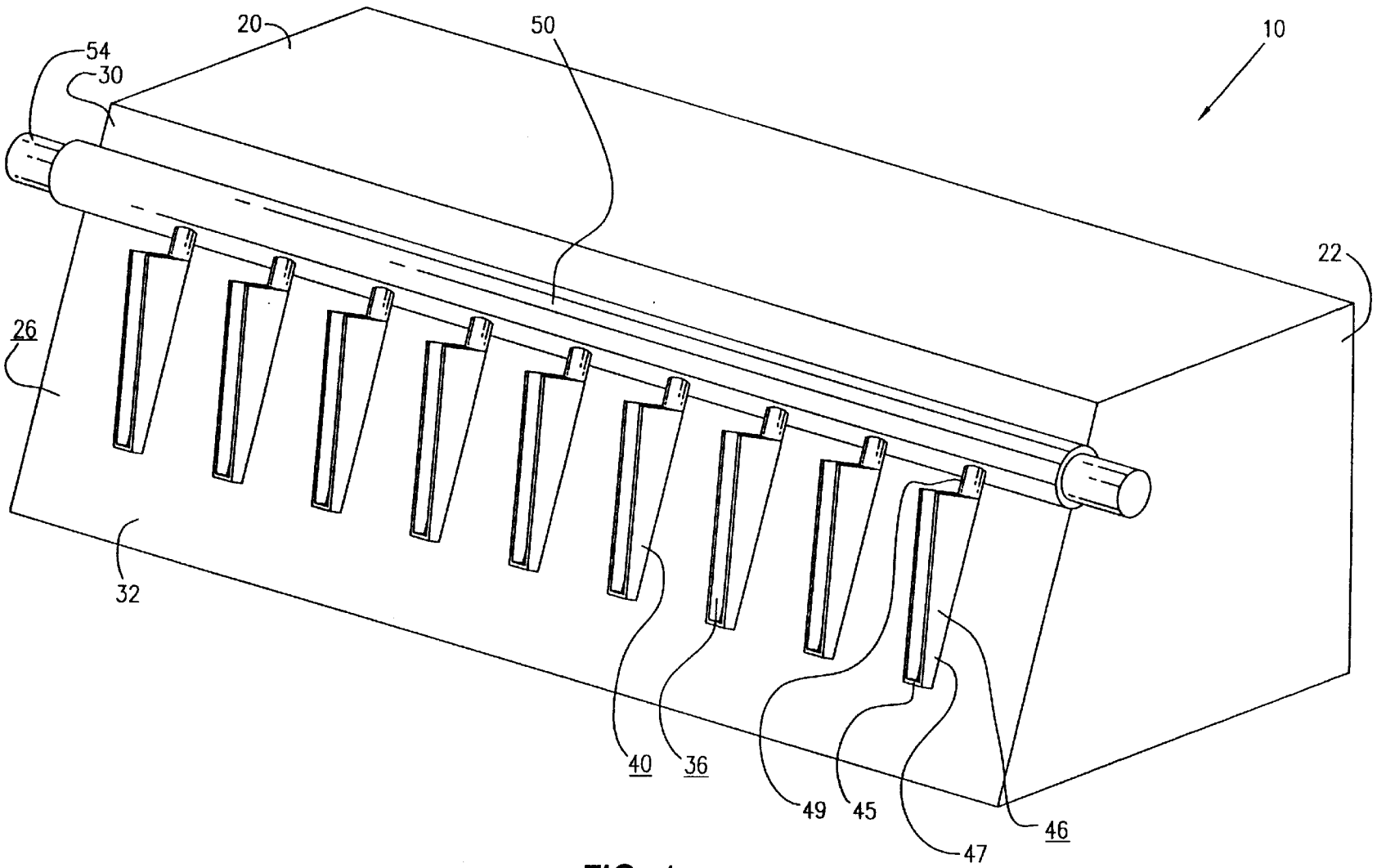
FIG. 1 is an isometric view of a bubble generator.
Figure 2:
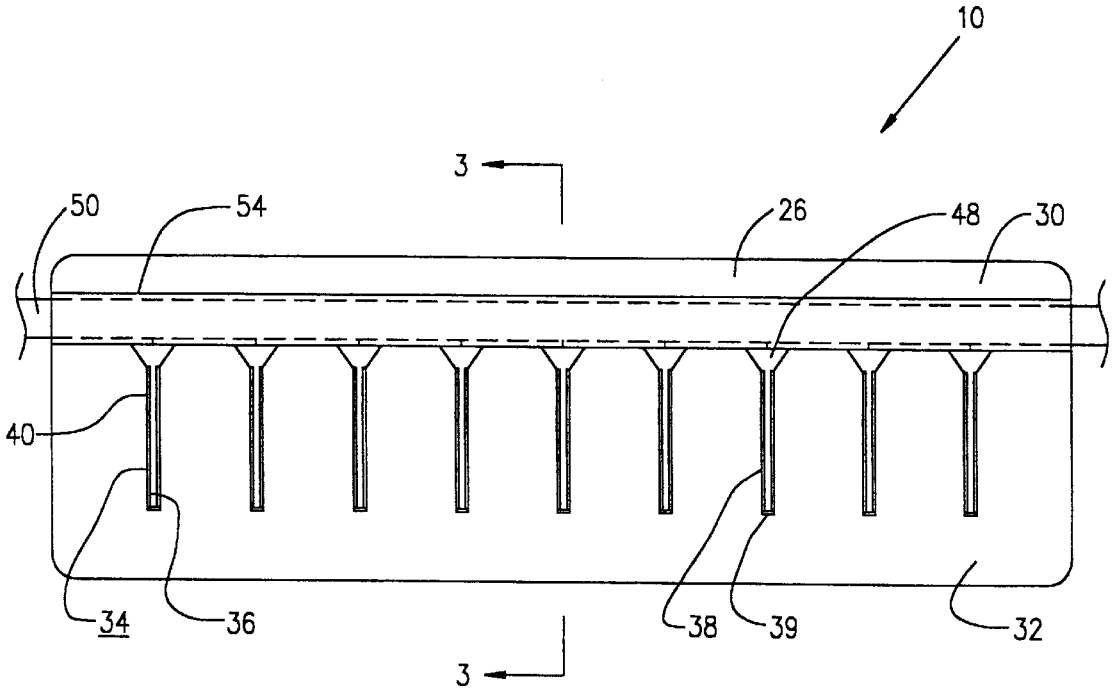
FIG. 2 is a view of an alternative embodiment of a face plate of the bubble generator.
Figure 3:
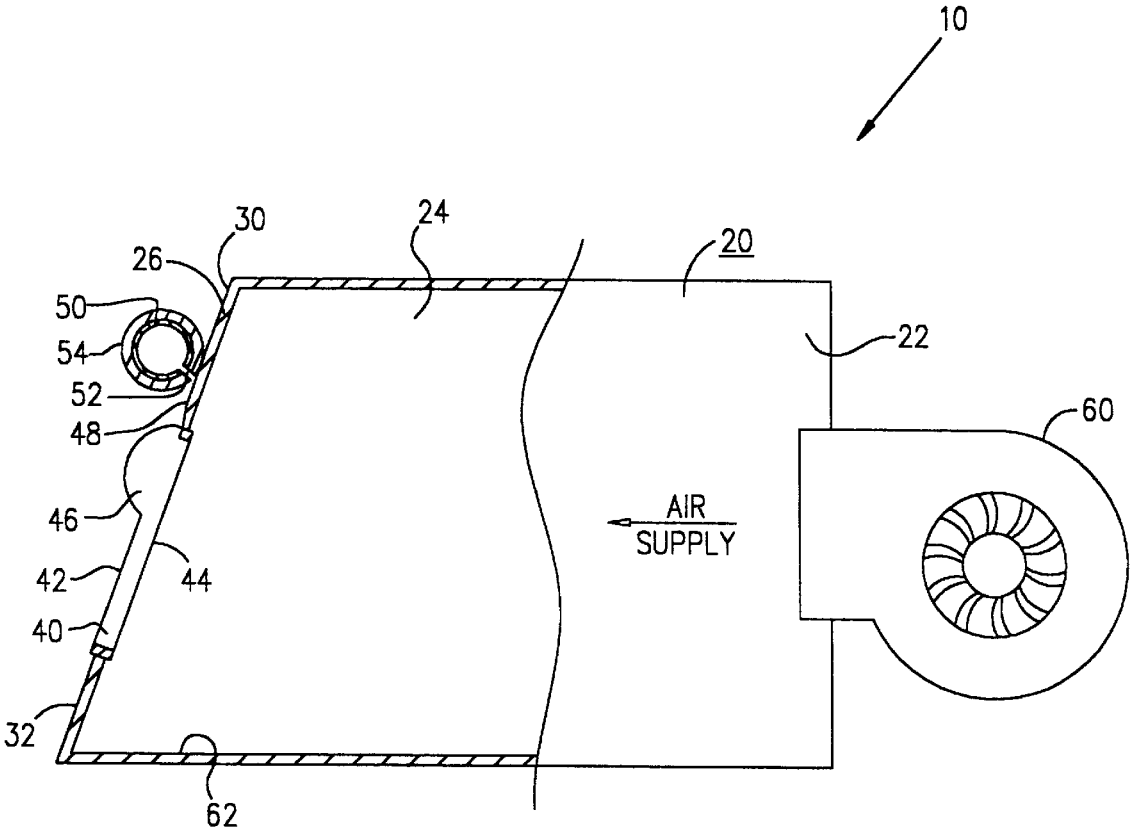
FIG. 3 is a view taken along line 3—3 of FIG. 2.

Referring to FIGS. 1–3, a bubble generator 10 has static components which produce a continuous stream of substantially uniform bubbles. The bubble generator 10 includes a container or plenum 20 having walls 22 which enclose a space 24. The pressure of the air in the enclosed space 24 is greater than that of the outside atmosphere. The components of the bubble generator 10 may be plastic, stainless steel, or other corrosion resistant material.

One of the walls 22 of the plenum 20 is a face plate 26 having an inside surface and an outside surface. Preferably, the face plate 26 has an inclined surface. As one example, the face plate 26 may be inclined relative to the other walls 22 of the plenum 20 and relative to the ground. Alternatively, the entire plenum 20 may be positioned at an angle so that the face plate 26 is inclined relative to the ground. The face plate 26 has a top portion 30, a bottom portion 32 and a plurality of nozzles 34 positioned therebetween. As an example, the face plate 26 may be inclined at an angle, such as approximately 70° with respect to the ground or a horizontal plane.

The nozzle 34 includes a slot 36 and an insert 40. The slots 36 are elongated openings which extend longitudinally from the top portion 30 towards the bottom portion 32 of the face plate 26. Preferably, the slot 36 is rectangularly shaped and has elongated sides 38 and narrow sides 39. Alternatively, the slot 36 may be oval, circular, square, triangular, or the like. As one example, a rectangular slot may be approximately ⅛" thick by 1½ inch long. The size of the width of the slot 36 determines whether the film will automatically form within the slot 36 without the use of mechanical means.

The insert 40, which may be a separate component or integrally formed with the face plate 26, is positioned within the slot 36 or on the surface of the face plate 26 and is attached to the face plate 26. The insert 40 extends perpendicularly to the face plate 26 and has at least one first edge 42 or wall which is positioned and extends above the outside surface of the face plate 26. Preferably, the insert 40 also has at least one second edge 44 or wall which extends below the inside surface of the face plate 26 into the plenum 20, and is positioned perpendicular to the face plate 26. Preferably, the insert 40 has three edges 42 and three edges 44 which are positioned at each of the elongated sides 38 and at one of the narrow sides 39 or bottom side of the rectangularly shaped slot 36.

The insert 40 has an extension 46 with the portion of the extension 46 positioned closest to the top portion 30 of the face plate 26 having a greater width than the portion of the insert 40 or extension 46 positioned farthest from the top portion 30 of the face plate 26 for providing lift and buoyancy to the bubbles The extension 46 may be integrally formed with the insert 40 or a separate component As illustrated in FIG. 3, the extension 46 may be a lip or protuberance, such as an arcuately shaped projection having a semi-circular portion extending from an upper portion of the insert 40, or the protuberance may have any suitable shape.

Alternatively, and as illustrated in FIG. 1, the extension 46 of the insert 40 includes first and second elongated walls 47 and a narrow wall 45 positioned therebetween and at a lower portion of the insert 40 closest to the bottom portion 32 of the face plate 26. The extension 46 may be designed so that the elongated walls 47 of the insert 40 have varying widths. The width of the top portion of the elongated wall 47 is greater than the width of the bottom portion of the elongated wall 47 for providing the same lift and advantages of the extension 46 as illustrated in FIG. 3. The narrow wall 45 may have substantially the same width as the bottom portion of the elongated wall 47. Preferably, the extension 46 includes a first extension portion attached to one side of the insert edge 42 and a second extension portion attached to an opposite side of the insert edge 42.

The face plate 26 also has a passageway for liquid for directing a flow of liquid into the slot 36. As illustrated in FIGS. 2 and 3, the passageway may be a trough 48 which is a triagularly shaped recess. The trough 48 is positioned so that the wider part of the triangle faces the top portion 30 of the face plate 26 and the narrower part of the triangle faces the bottom portion 32 of the face plate 26. The narrower part of the trough 48 is positioned adjacent to and contacts the slot 36. Alternatively, the trough 48 may have raised edges, may be rectangularly shaped or have any other suitable shape for directing a flow of liquid into the slot 36. As illustrated in FIG. 1, the passageway may be an enclosed channel 49 which is in communication with a supply of liquid and with the slot 36. The enclosed design of the channel 49 substantially prevents leakage or spillage of liquid onto the face plate 26. Additionally, the flow of liquid through the channel 49 is uninterrupted by wind or other environmental conditions.

A liquid supply manifold 50 extends across the top portion 30 of the face plate 26 above the nozzles 34, and may be attached to the plenum 20. The liquid supply manifold 50 has a series of holes 52 which extend across the surface of the face plate 26. Liquid, such as any surfactant, detergent, soap mixture, or the like, is supplied from a reservoir (not shown) through the liquid supply manifold 50 and is dispensed through the holes 52 into the passageway, such as the trough 48 or the channel 49. The liquid flows down the passageway and forms a film across the slot 36. The diameter of the holes 52 control the liquid flow.

Alternatively, as illustrated in FIGS. 2 and 3, the liquid supply manifold 50 may be contained within a housing 54, such as a tube or cylinder. The housing 54 may be attached to the plenum 20 or integrally formed with the plenum 20, and has a plurality of holes 56 in alignment with the holes 52 of the liquid supply manifold 50. The housing 54 protects the liquid supply manifold 50 from damage, environmental conditions or the like.

An air supply 60, such as a compressed air source, blower air source, or other induced air flow, is attached to the plenum 20. Alternatively, the air supply 60 may be separate from the plenum 20, such as an already existing air supply which may be used to supply the flow of air to the nozzles 34. The air supply 60 directs air into and through the plenum 20. The air from within the plenum 20 flows into the film across the nozzle 34, which expands the film and releases the film from the nozzle 34 in the form of a bubble.

In operation, a bubble solution is supplied from the reservoir by gravity, pumping or pressure to the liquid supply manifold 50. The holes 52 in the liquid supply manifold 50 supply the liquid to the trough 48 or channel 49 which directs the liquid to the slot 36. The liquid flow can be controlled by the size of the holes 52 in the liquid supply manifold 50 and by the pressure on the reservoir.

The insert 40 in the slot 36 prevents the liquid from preferentially flowing down the surface of the generator face or into the plenum 20 and along the interior surface of the face plate 26. The insert 40 contains the flow of the liquid. As the liquid flows over the narrow slot 36, it forms a film. Air flow through the slot 36 produces a constant stream of bubbles as long as liquid flows. The bubble size can be controlled by the dimensions of the nozzle 34 and the air flow.

The extension 46 on the insert 40 causes the bubbles to form towards the top of the insert 40, producing a more buoyant stream of bubbles. The extension 46 helps the bubble come off of the nozzle 34 and reduces excess liquid in the bubble. Excess liquid drains through the slot 36 and into the plenum 20, such as into a reservoir 62, and can be recycled. Any number of nozzles 34 can be used for an array which produces large number of bubbles in a small cross section.

An advantage of the bubble generator 10 is that since there are no moving parts, the bubble generator 10 is simpler and has less maintenance and greater reliability. No mechanical dipping or priming pad is needed. Once the air flow is stopped, the film will quickly reform across the nozzle 34. Also, the static design allows more bubble generation sites in a given cross section, enabling a greater density of nozzles 34. The stationary nozzle, produces a continuous stream of bubbles, increasing the production rate of the bubble generator 10.

The passive design produces more uniform bubbles. By keeping the liquid and air flow constant, a continuous stream of uniform bubbles is produced. More buoyant bubbles are produced because by increasing the air flow, very light bubbles can be produced which stay airborne for a long period of time. Additionally, a drier bubble is more buoyant and stays airborne longer.

The insert 40 substantially prevents the face plate 26 from getting wet. If the face plate 26 gets wet, the bubble spreads and does not release as well from the bubble generator. Keeping the face of the bubble generator dry, enables a better release of the bubble.

The passive design also better enables the bubble characteristics to be controlled. The liquid and air flow can be quickly controlled, allowing the bubble characteristics such as size and buoyancy to be changed and to accommodate a wide variety of liquids.

Thus there has been shown and described a novel bubble generator which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A bubble generator, comprising:

a plenum having a plurality of walls enclosing a space, at least one of said walls inclined relative to the ground, and one of said inclined walls having a top portion, a bottom portion and a plurality of slots positioned therebetween;

a liquid supply manifold positioned at said top portion of said inclined wall and having at least one hole for dispensing liquid from said liquid supply manifold for enabling said liquid to flow into said slots for forming a film across said slots;

an insert positioned within each of said plurality of slots and having at least one first edge extending beyond said inclined wall and perpendicularly from said inclined wall for forming said film within said slot and for substantially preventing said liquid from contacting said inclined wall; and an air supply in communication with said plenum for directing air through said space of said plenum and into said film positioned across said slots for producing a buoyant stream of bubbles.

2. The bubble generator according to claim 1, wherein said insert has at least one second edge which extends within said plenum for enabling said film to form within said slot.

3. The bubble generator according to claim 1, wherein said insert has an extension extending vertically upwardly from said insert, said extension has a portion positioned closest to said liquid supply manifold with a width greater than a width of said first edge of said insert for providing lift to each bubble of said bubble stream.

4. The bubble generator according to claim 1, wherein said slot is rectangularly shaped and extends longitudinally from said top portion of said inclined wall toward said bottom portion of said inclined wall.

5. The bubble generator according to claim 1, further comprising a housing attached to said top portion of said inclined wall for containing said liquid supply manifold.

6. The bubble generator according to claim 1, wherein said inclined wall has a passageway positioned between said liquid supply manifold and each of said slots for directing the flow of said liquid from said liquid supply manifold to said slots.

7. The bubble generator according to claim 1, wherein said plenum has a reservoir for collection of excess liquid.

8. The bubble generator according to claim 1, wherein said insert is integrally formed with said inclined wall of said plenum.

9. A bubble generator, comprising:

a container having a plurality of walls enclosing a space therebetween, said walls having an inside surface facing toward said space and an outside surface facing away from said space, one of said walls having at least one nozzle across which a liquid film may be formed;

said nozzle including a slot disposed through said wall of said container and having an insert positioned within said slot, said insert having at least one edge that extends beyond at least one of said inside and outside surfaces of said wall having said at least one nozzle;

a liquid supply manifold positioned above said at least one nozzle of said container and having at least one hole for dispensing liquid from said liquid supply manifold for enabling said liquid to flow into said at least one nozzle for forming said liquid film within said slot; and an air supply in communication with said container for directing air through said space of said container and into said liquid film positioned across said slot of said nozzle for producing at least one bubble.

10. The bubble generator according to claim 9, wherein said wall having said nozzles is inclined relative to the ground.

11. The bubble generator according to claim 9, further comprising a passageway positioned on said wall of said container between said liquid supply manifold and said nozzle for directing the flow of liquid toward said slot.

12. The bubble generator according to claim 11, wherein said passageway is an enclosed channel integrally formed with said wall for enclosing the flow of liquid from said liquid supply manifold to said slot.

13. The bubble generator according to claim 9, further comprising an extension positioned extending upwardly from said insert, said extension having a greater width closest to said liquid supply manifold as compared to a width of said insert positioned farthest from said liquid supply manifold for providing lift to said bubble.

14. The bubble generator according to claim 9, wherein:

said slot is rectangularly shaped having elongated sides and narrow sides; and said at least one edge of said insert including an edge positioned at each of said elongated sides and at one of said narrow sides of said rectangularly shaped slot.

15. The bubble generator according to claim 9, wherein said air supply is attached to said container.

16. The bubble generator according to claim 9, further comprising a housing integrally formed with said wall of said container for housing said liquid supply manifold.

17. The bubble generator according to claim 9, wherein said liquid supply manifold is attached to said container.

* * * * *